US010472709B2

(12) United States Patent
McDonald et al.

(10) Patent No.: US 10,472,709 B2
(45) Date of Patent: Nov. 12, 2019

(54) HIGH STRENGTH, HIGH CONDUCTIVITY ELECTROFORMED COPPER ALLOYS AND METHODS OF MAKING

(71) Applicant: Apple Inc., Cupertino, CA (US)

(72) Inventors: Daniel T. McDonald, San Francisco, CA (US); James A. Wright, Los Gatos, CA (US); Wai Man Raymund Kwok, Hong Kong (HK)

(73) Assignee: Apple Inc., Cupertino, CA (US)

( * ) Notice: Subject to any disclaimer, the term of this patent is extended or adjusted under 35 U.S.C. 154(b) by 268 days.

(21) Appl. No.: 15/376,371

(22) Filed: Dec. 12, 2016

(65) Prior Publication Data

US 2017/0167007 A1 Jun. 15, 2017

Related U.S. Application Data

(60) Provisional application No. 62/266,502, filed on Dec. 11, 2015.

(51) Int. Cl.

| | |
|---|---|
| ***C22C 9/00*** | (2006.01) |
| ***C22F 1/08*** | (2006.01) |
| ***C25D 1/00*** | (2006.01) |
| ***C25D 3/38*** | (2006.01) |
| ***H01R 13/03*** | (2006.01) |
| ***H01R 4/58*** | (2006.01) |

(52) U.S. Cl.

CPC ..... *C22F 1/08* (2013.01); *C22C 9/00* (2013.01); *C25D 1/00* (2013.01); *C25D 3/38* (2013.01); *H01R 4/58* (2013.01); *H01R 13/03* (2013.01)

(58) Field of Classification Search

None

See application file for complete search history.

(56) References Cited

FOREIGN PATENT DOCUMENTS

| | | | | |
|---|---|---|---|---|
| JP | 02-240230 | * | 9/1990 | ..... C22C 9/00 |
| JP | 2006-219705 | | 8/2006 | |
| JP | 2008-069374 | | 3/2008 | |
| JP | 2009-079281 | | 4/2009 | |
| JP | 2011-246802 | | 12/2011 | |
| JP | 2016-069713 | | 5/2016 | |

OTHER PUBLICATIONS

Machine-English translation of JP02-240230, Matsumoto Tatsuhiko et al., Sep. 25, 1990.*

Machine-English translation of JP 2006-219705, Kan Kazuki et al., Aug. 24, 2006.*

* cited by examiner

*Primary Examiner* — Colin W. Slifka

(74) *Attorney, Agent, or Firm* — Polsinelli PC

(57) ABSTRACT

An electroformed binary copper alloy comprising copper and X, where X is selected from the group consisting of Cr, Fe, W, Mo, B, Co, Ag, and P, having a yield strength of at least 600 MPa and an electrical conductivity of at least 20% IACS is disclosed.

18 Claims, 5 Drawing Sheets

HIGH STRENGTH, HIGH CONDUCTIVITY ELECTROFORMED COPPER ALLOYS AND METHODS OF MAKING

CROSS-REFERENCE TO RELATED APPLICATIONS

The present application claims the benefit under 35 U.S.C. § 119(e) of U.S. Provisional Appl. No. 62/266,502, entitled "High Strength, High Conductivity Electroformed Copper Alloys and Methods of Making," filed on Dec. 11, 2015, which is incorporated herein by reference in its entirety.

FIELD

The described embodiments relate generally to copper binary alloys with high strength and high conductivity and methods of forming such alloys. More particularly, various embodiments relate to electroforming binary Cu—X alloys and methods of grain refinement and precipitation hardening of the binary Cu—X alloys.

BACKGROUND

Copper has long been the main material used to conduct electricity. Various copper alloys have been developed to overcome shortcomings of elemental copper, such as low strength and flexure life. High strength and flexure life, consistent with maintaining high conductivity, are important requirements for many applications.

While pure Cu and some copper alloys have good conductive performance (e.g. 100% IACS) these materials have low strength (e.g., 400 MPa) making them unsuitable for many applications. Strengthening Cu and its alloys can be achieved through several methods, such as grain refinement, precipitation hardening, cold working, or solid solution alloying. However, such approaches can lead to a decrease in conductivity. For example, alloying pure Cu by adding elements (Si, Al, Fe, Ni, Sn, Cd, Zn, Ag, Sb, Mg, Cr, etc.) may increase the strength by two or three times, but the electrical conductivity of Cu alloys can decrease dramatically. Furthermore, the volatilities of some alloy elements, such as Cd, Zn, Sn, and Pb, could limit their application in the electronics industry, especially in high temperature and high vacuum environments, Therefore, there is a need to develop copper alloys that have high strength and high conductivity.

SUMMARY

Embodiments of the disclosure are directed to an electroformed binary copper alloy comprising copper (Cu) and X, where X is selected from the group consisting of Cr, Fe, W, Mo, B, Co, Ag, and P, having a yield strength of at least 600 MPa and an electrical conductivity of at least 20% IACS. In some embodiments, X is selected from a group consisting of Cr, Fe, W and Mo. In other embodiments, the alloy may have a yield strength of at least 900 MPa. In some embodiments, the alloy may have an electrical conductivity of at least 30% IACS. In yet other embodiments, the alloy may have a yield strength between 900 MPa and 1700 MPa. In still other embodiments, the alloy may have an electrical conductivity between 30 and 70% IACS.

In some embodiments, the binary Cu—X alloys can have electrical conductivity of at least 80% IACS along with yield strengths between 600-900 MPa. These alloys may be useful for forming electrical connectors that can be used for circuit board connections in electrical devices. In other embodiments, the binary Cu—X alloys can have electrical conductivity of at least 80% IACS along with yield strengths between 1000-1200 MPa. In still other embodiments, the binary Cu—X alloys can have electrical conductivity of at least 50% IACS along with yield strengths between 900-1500 MPa.

In some embodiments, the Cu and X ions can have different electrode potentials (i.e., reduction potential). In some embodiments, the difference in electrode potential, ΔV, between Cu and X is less than ±0.25 V. In other embodiments, the difference in electrode potential, ΔV, between Cu and X is greater than ±0.5 V. In still other embodiments, the difference in electrode potential between Cu and X, ΔV, can range between −1.0 V to 1.0.

In embodiments of the disclosure, the Cu—X alloy can include at least 0.1 wt. % of X. In other embodiments of the disclosure, the Cu—X alloy can include 0.1 wt. % to 0.5% of X. In still other embodiments of the disclosure, the Cu—X alloy can include at least 1 wt. % of X. In yet embodiments of the disclosure, the Cu—X alloy can include up to 30 wt. % of X. For example, in some embodiments, X may be Mo and the weight percent of Mo may range from 0.1 wt. % to 0.5 wt. %.

Other embodiments of the disclosure are directed to methods of making a binary Cu—X alloy having high strength and high electrical conductivity. In some embodiments, the method of making an electroformed binary copper alloy can include preparing an electrolyte bath with Cu and X ions, where X is selected from the group consisting of Cr, Fe, W, Mo, B, Co, Ag, and P; submerging at least a portion of a cathode preform in the electrolyte bath; applying a current to the electrolyte bath; depositing the Cu and X ions on a portion the cathode preform to form a binary Cu—X alloy; and heat treating the binary Cu—X alloy to precipitate particles of X and/or $Cu_yX_z$ to form an electroformed Cu—X article.

In some embodiments, the electrolyte bath comprises at least 0.1 wt. % of X ions. In some embodiments, the electrolyte bath comprises up to 30 wt. % of X ions.

In embodiments of the disclosure, the electrolyte bath can include chemical complexes to make the electrode potential of the Cu and X ions compatible. In other embodiments, the electrolyte bath can include chemical additives for grain refining the Cu phase.

In some embodiments, the method can include heat treating the binary Cu—X alloy to increase the hardness of the binary Cu—X alloy. The heat treatment process can involve heating the binary Cu—X alloy to a temperature of at least 100° C. for a time. In some embodiments, the binary Cu—X alloy can be heated to a temperature of at least 200° C., while in other embodiments, the binary Cu—X can be heated alloy to a temperature of at least 350° C. In still other embodiments, the binary Cu—X alloy can be heated to a temperature of at least 400° C. In some embodiments, the binary Cu—X alloy may be heated for at least 30 minutes, while in other embodiments the alloy may be heated for at least 100 minutes. In yet other embodiments, the binary Cu—X alloy may be heated for a time ranging from 30 minutes to 300 minutes.

In some aspects, the heat treating can include heating to precipitate harden the binary Cu—X alloy. In such embodiments, the heat treating can include heating the binary Cu—X alloy at a temperature and/or time sufficient to precipitate out intra-grain particulates of X and/or $Cu_yX_z$ to comprise at least 0.1% volume fraction of the alloy. In other embodiments, the intra-grain particulates of X and/or $Cu_yX_z$ can comprise at least 0.25% volume fraction of the alloy. In other embodiments, the method can include heat treating the binary Cu—X alloy at a temperature and/or time sufficient to precipitate out intra-grain particulates of X and/or $Cu_yX_z$ to comprise at least 1% volume fraction of the alloy; while in other embodiments, the intra-grain particulates of X and/or $Cu_yX_z$ is at least 5% volume fraction of the alloy. In still other embodiments, the method can include heat treating the binary Cu—X alloy at a temperature and/or time sufficient to precipitate out intra-grain particulates of X and/or $Cu_yX_z$ to comprise up to 30% volume fraction of the alloy.

In some embodiments, the binary Cu—X alloy can include X as a nano-scale particulate phase in the alloy precipitated from the solid solution during an aging treatment. In embodiments of the disclosure the intra-grain particulates can comprise X and/or $Cu_yX_z$ particles. In some embodiments, the alloys can include at least 0.1% vol. fraction of X and/or $Cu_yX_z$ particles as intra-grain particulates. In some embodiments, the alloys can include at least 0.25% vol. fraction of X and/or $Cu_yX_z$ particles as intra-grain particulates. In some embodiments, the alloys can include at least 1% vol. fraction of X and/or $Cu_yX_z$ particles as intra-grain particulates. In some embodiments, the alloys can include at least 5% vol. fraction of X and/or $Cu_yX_z$ particles as intra-grain particulates. In other embodiments, the alloys can include up to 15% vol. fraction of X and/or $Cu_yX_z$ particles as intra-grain particulates.

In some embodiments, the method can further include a step of separating the electroformed Cu—X article from the cathode preform.

Other embodiments of the disclosure are directed to article/devices made from the electroformed binary Cu—X alloy. In some embodiments, the articles/devices can include electrical connectors comprising a electroformed binary copper alloy comprising copper and X, where X is selected from the group consisting of Cr, Fe, W, Mo, B, Co, Ag, and P, having a yield strength of at least 800 MPa and an electrical conductivity of at least 20% IACS.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The disclosure relates to electroformed copper (Cu) binary alloys with high strength and high conductivity, methods of making the copper binary alloys, and articles or devices made thereof. Embodiments of the disclosure are directed to electroformed binary Cu—X alloys that have high strength (e.g. at least 600 MPa) and high electrical conductivity (e.g. at least 20% IACS). In some embodiments, the Cu—X alloys may have a yield strength of at least 900 MPA and a conductivity of at least 30% IACS. In other embodiments, the Cu—X alloys may have a yield strength between 900 MPA and 1700 MPa, and a conductivity between 30% IACS and 70% IACS. In other embodiments, the Cu—X alloys may have a yield strength between 600 MPA and 1000 MPa, and a conductivity between 80% IACS and 95% IACS. In still other embodiments, the Cu—X alloys may have a yield strength between 900 MPA and 1200 MPa, and a conductivity between 80% IACS and 95% IACS. In some embodiments, the Cu—X binary alloys can also have improved shear modulus for enhanced fatigue performance.

To improve the strength of copper, alloying elements can be added. Further, optional heat treating and/or precipitating hardening processes can be further used to create binary copper alloys that have a combination of high strength, high conductivity, and good formability. Although the addition of an alloying element to the copper can increase the yield strength, it can also reduce the electrical conductivity. Without wishing to be limited to a particular theory or mode of action, in various aspects the greater solute concentration of X, the more of X that can enter the Cu-phase of the alloy, which can reduce the electrical conductivity. In contrast to ingot metallurgy, in embodiments of the disclosure, the concentration of X can be increased. In ingot metallurgy the weight % of X that is soluble in Cu can be low (e.g., 1 wt. % or less), while the electroforming process of the disclosure can increase the wt. % of X that is soluble in Cu.

Figure 1A:
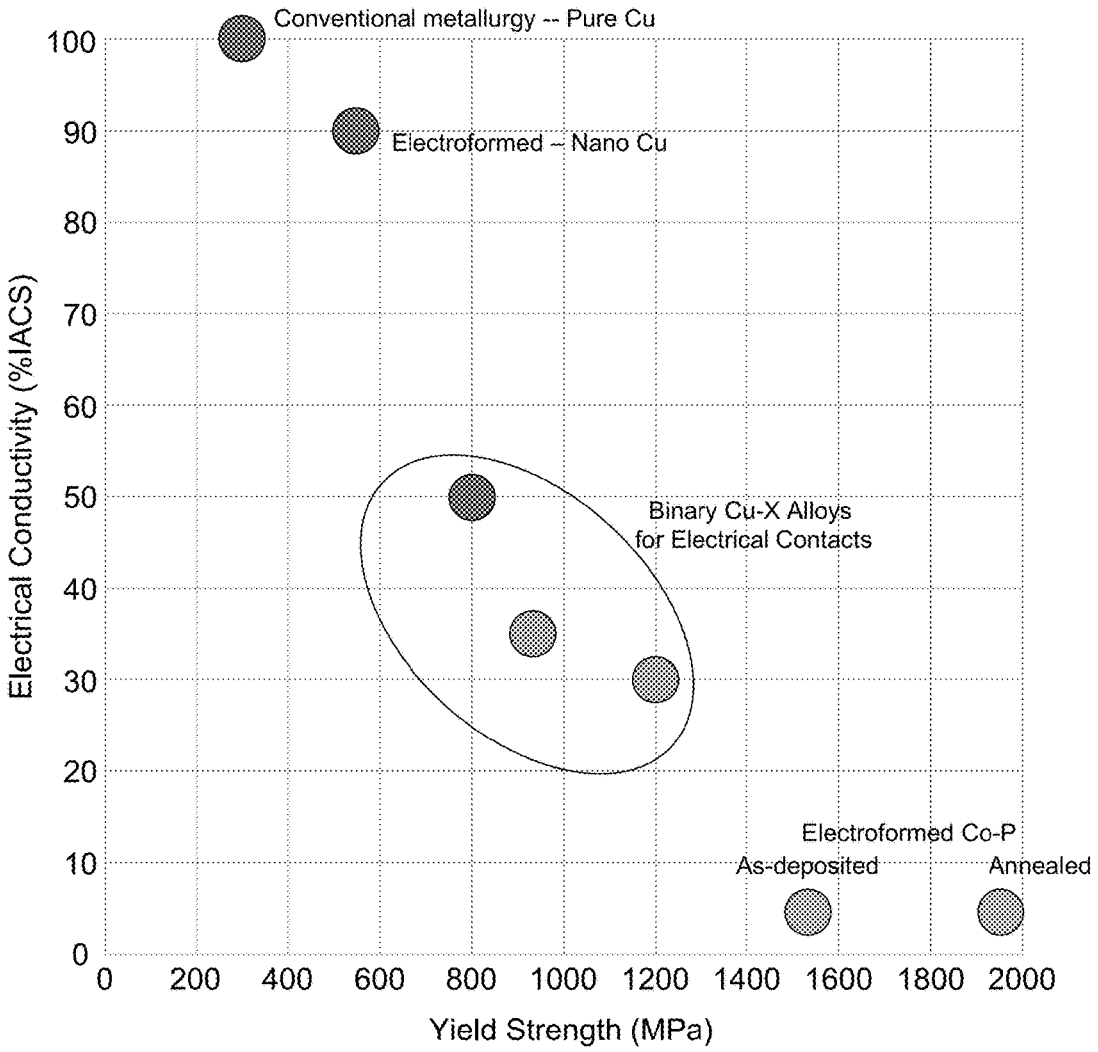
FIG. 1 A depicts a graphical representation of the relationship between electrical conductivity and yield strength for various Cu and Cu alloy systems.
FIG. 1B depicts another graphical representation of the relationship between electrical conductivity and yield strength for various Cu and Cu alloy systems.

FIG. 1 A shows a graphical representation of the relationship between electrical conductivity and yield strength for copper and copper alloys. In such conventional metallurgy, electrical conductivity and yield strength are inversely related. For example, as shown in FIG. 1A, pure conventional metallurgical copper (e.g., Pure Cu) and pure electroformed nano copper (e.g., Nano Cu) have electrical conductivity of 80% IACS or greater, while the yield strength of both is below 600 MPa. Conversely, electroformed Co—P alloys (e.g., as-deposited and annealed) have yield strength in excess of 1500 MPa, but electrical conductivity of less than 10% IACS.

However, embodiments of the disclosure are directed to electroformed binary copper alloys (e.g., Cu—X alloys) that have both high electrical conductivity (at least 20% IACS) and high yield strength (at least 600 MPa). In embodiments of the disclosure, the yield strength of copper and/or copper alloys can be improved by increasing the volume fraction of an alloying element X by co-depositing Cu and X through an electroforming process. In some embodiments, binary Cu—X alloys can also have improved shear modulus for enhanced fatigue performance.

In some aspects, the binary copper alloys have an electrical conductivity of at least 20% IACS. In some aspects, the binary copper alloys have an electrical conductivity of at least 25% IACS. In some aspects, the binary copper alloys have an electrical conductivity of at least 30% IACS. In some aspects, the binary copper alloys have an electrical conductivity of at least 35% IACS. In some aspects, the binary copper alloys have an electrical conductivity of at least 40% IACS. In some aspects, the binary copper alloys have an electrical conductivity of at least 45% IACS. In some aspects, the binary copper alloys have an electrical conductivity of at least 50% IACS. In some aspects, the binary copper alloys have an electrical conductivity of at least 55% IACS. In some aspects, the binary copper alloys have an electrical conductivity of at least 60% IACS. In some aspects, the binary copper alloys have an electrical conductivity of at least 65% IACS. In some aspects, the binary copper alloys have an electrical conductivity of at least 70% IACS. In some aspects, the binary copper alloys have an electrical conductivity of at least 80% IACS.

In some aspects, the binary copper alloys have a yield strength of at least 600 MPa. In some aspects, the binary copper alloys have a yield strength of at least 700 MPa. In some aspects, the binary copper alloys have a yield strength of at least 800 MPa. In some aspects, the binary copper alloys have a yield strength of at least 900 MPa. In some aspects, the binary copper alloys have a yield strength of at least 1000 MPa. In some aspects, the binary copper alloys have a yield strength of at least 1100 MPa. In some aspects, the binary copper alloys have a yield strength of at least 1200 MPa. In some aspects, the binary copper alloys have a yield strength of at least 1300 MPa. In some aspects, the binary copper alloys have a yield strength of at least 1400 MPa. In some aspects, the binary copper alloys have a yield strength of at least 1500 MPa. In some aspects, the binary copper alloys have a yield strength of at least 1600 MPa.

In various aspects, the high strength, high conductivity binary Cu—X alloys can be made by an electroforming process. The electroforming process includes co-depositing Cu and an alloying element X. X can be selected from a group consisting of Cr, Fe, W, Mo, B, Co, Ag, and P.

Some embodiments of the disclosure are directed to electroformed binary Cu—X alloys that have high strength (e.g. at least 600 MPA) and high electrical conductivity (e.g. at least 20% IACS). In other embodiments, the binary Cu—X alloys may have a yield strength of at least 900 MPA and a conductivity of at 30% IACS. In other embodiments, the binary Cu—X alloys may have a yield strength between 600 MPA and 900 MPa, and a conductivity between 80% IACS and 95% IACS, while in other embodiments the binary Cu—X alloys may have a yield strength between 1000 MPA and 1200 MPa, and a conductivity between 80% IACS and 95% IACS. In yet other embodiments, the binary Cu—X alloys may have a yield strength between 900 MPA and 1700 MPa, and a conductivity between 30% IACS and 70% IACS.

Figure 1B:
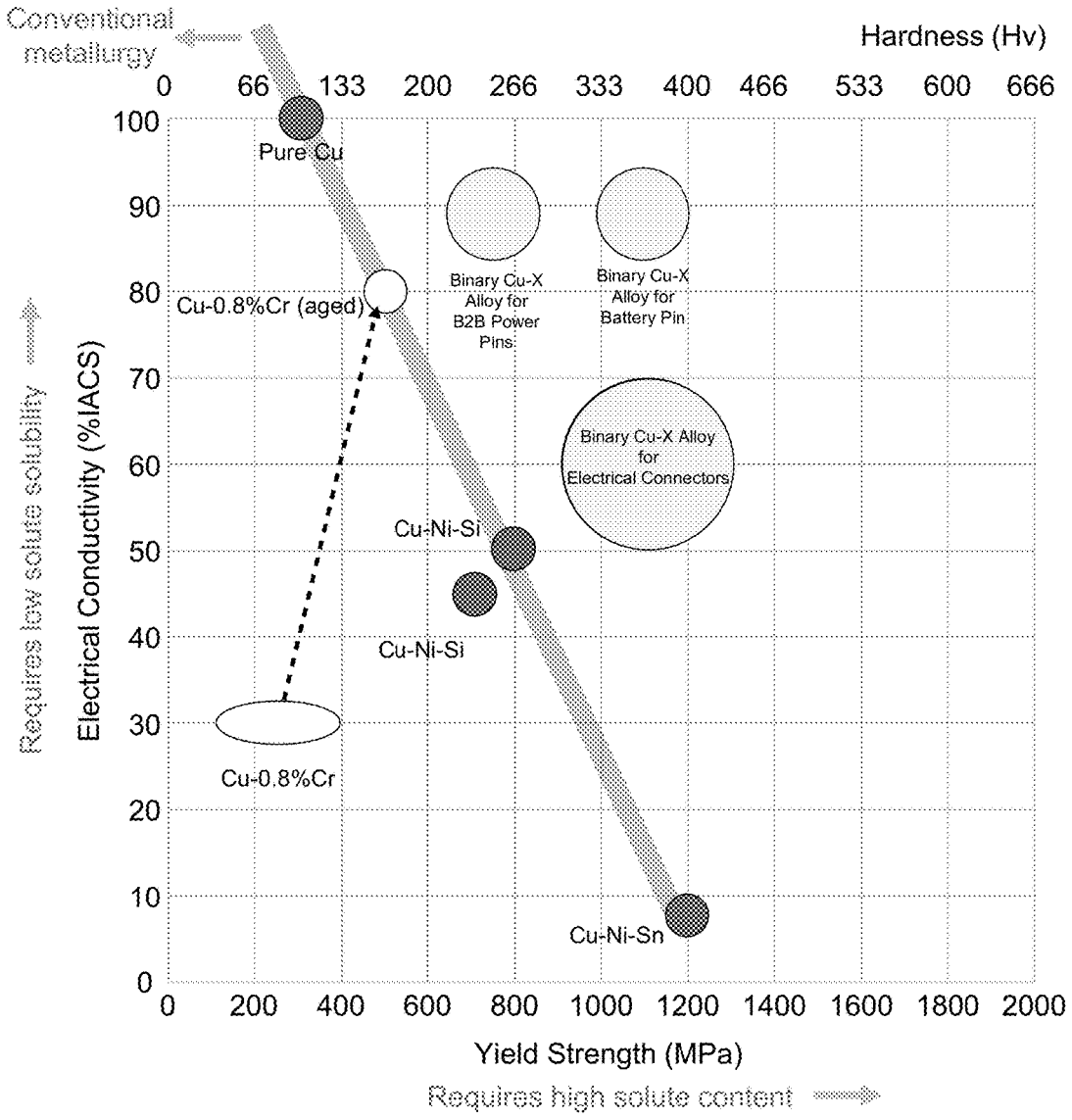

FIG. 1B shows a graphical representation of the relationship between electrical conductivity and yield strength for conventional metallurgy copper and copper alloys in comparison to electroformed binary copper alloys in accordance with embodiments of the disclosure. As shown in FIG. 1B, conventional metallurgy pure Cu and Cu alloys have a tendency to have an inverse reverse relationship between electrical conductivity and yield strength. For example, as the yield strength increases to 1200 MPa for a Cu—Ni—Sn alloy the electrical conductivity is less than 10% IACS in comparison to pure Cu that has electrical conductivity greater than 90% IACS with a yield strength of less than 400 MPa.

In contrast, embodiments of the disclosure are electroformed binary Cu—X alloys that have both high electrical conductivity (at least 20% IACS) and high yield strength (at least 600 MPa). In some embodiments, as shown, the binary Cu—X alloys can have electrical conductivity of at least 80% IACS along with yield strengths between 600-900 MPa. These alloys may be useful for forming electrical connectors that can be used for circuit board connections in electrical devices (e.g. B2B power pins). In other embodiments, as shown, the binary Cu—X alloys can have electrical conductivity of at least 80% IACS along with yield strengths between 1000-1200 MPa. These alloys may be useful for forming electrical connectors that can be used for battery pins in electrical devices. In still other embodiments, the binary Cu—X alloys can have electrical conductivity of at least 50% IACS along with yield strengths between 900-1500 MPa for other types of electrical connectors.

In various aspects, the alloys of the disclosure can be made through an electroforming process. An "electroforming," process, also sometimes referred to as "electrodeposition," or "electroplating," is an electrochemical process that passes an electrical current between an anode and a cathode through an aqueous or non-aqueous solution containing metal ions. The ions are reduced and deposited on the cathode. The cathode can be a pre-form, a model, or mandrel. Electroforming differs from ordinary electrodeposition or electroplating coatings in that electroforms are used as separate structures, rather than as coatings to provide decorative effects, corrosion resistance, or the like.

The basic steps of an electroforming process can include: preparation of an electrolyte bath (also can be referred to as a plating bath or solution) containing the metal ions to be deposited, placing a cathode preform, mold or mandrel in the electrolyte bath and applying a current to the electrolyte bath. The metal ions in the electrolyte bath plate out of the electrolyte bath and are deposited upon the cathode preform, mold or mandrel by electrolysis. When the required thickness of metal has been applied, the metal-covered preform, mold or mandrel can be removed from the electrolyte bath and the electrodeposited metal is separated from the preform, mold, or mandrel to create an electroform, which is a separate, free-standing article composed entirely of the electrodeposited metal. The electroforming process can include co-depositing Cu and an alloying element X. X can be selected from a group consisting of Cr, Fe, W, Mo, B, Co, Ag, P, Sn, and Zn. In some embodiments X can be selected from a group consisting of Cr, Fe, W and Mo.

In some embodiments, the preform, mold, or mandrel is metal, for example but not limited to, brass or stainless steel. In some embodiments, the co-depositing of Cu and an alloying element X may proceed until at least a 50 um thick layer of the binary Cu—X alloy is deposited on the cathode preform. In other embodiments, the co-depositing Cu and an alloying element X may proceed until at least a 100 um thick layer of the binary Cu—X alloy is deposited on the cathode preform. In yet other embodiments, the co-depositing Cu and an alloying element X may proceed until at least a 200 um thick layer of the binary Cu—X alloy is deposited on the cathode preform.

The electroformed binary copper alloys can be used to make articles/devices such as electrical connectors (e.g., interconnects). The articles/devices made from the electroformed binary copper alloys can have improved electrical conductivity, improved yield strength, and/or improved fatigue performance in comparison to conventional ingot metallurgical copper alloys.

In addition, the improved electrical conductivity and the improved yield strength of the electroformed binary Cu—X alloys have a number of manufacturing benefits in comparison to manufacturing benefits of conventional ingot metallurgical copper alloys. For example, the increased yield strength can allow for a reduction in size of the electrical connectors while still maintaining mechanical integrity. In some embodiments, the electrical connectors made from embodiments of the binary Cu—X alloys may have at least a 10% reduction in size compared to electrical connectors of conventional alloys. For example, a B2B pin made from binary Cu—X alloys can have a reduction in height, length, or both that can reduce the overall size compared to conventional alloy electrical connectors. This reduction in size of the electrical connectors can reduce the amount of space that the connectors consume in electrical devices, thereby allowing for smaller devices and/or additional internal space for other components within the electrical devices. Additionally, the improved yield strength of the electrical connectors may also reduce the need for additional components that provide mechanical reinforcement. By way of illustration, without intending to be limiting, for example in a board to board display receptacle it may be possible to eliminate the need for a retention clip. Another benefit is that the increase electrically conductivity of the binary Cu—X alloys of the disclosure can allow for faster charging via the electrical connectors. Additionally, the electroforming process can allow for the making of net-shaped articles/devices that need little to no additional machining, finishing, and/or polishing.

In embodiments of the disclosure, Cu and X ions can be added to an electrolyte bath. In some embodiments, the concentration of the Cu and X ions in the electrolyte bath can be such that X is at least 0.1 wt. % or greater. In other embodiments, the concentration of the Cu and X ions in the electrolyte bath is such that X is at least 1 wt. % or greater. In yet other embodiments, the concentration of the Cu and X ions in the electrolyte bath is such that X is at least 5 wt. % or greater. In still other embodiments, the concentration of X can be up to 30 wt. %. In some embodiments, the concentration of the Cu and X ions in the electrolyte bath can be such that X ranges between 0.1 wt. % and 0.5 wt. %. In other embodiments, the concentration of the Cu and X ions in the electrolyte bath is such that X ranges between 0.1 wt. % and 1 wt. %.

In some embodiments, the electrolyte bath can be an aqueous solution; while in other embodiments, the electrolyte bath may be non-aqueous. In some embodiments, the electrolyte bath can also include additional chemical complexes or grain refining additives.

In embodiments of the disclosure, the Cu and X ions in the electrolyte bath can be electro-deposited on a cathode preform, mold, or mandrel by applying a current to the electrolyte bath to form net-shape articles. In some embodiments, the net-shape articles can be made to form electrical components, including electrical connector. In other embodiments the electrodeposited binary Cu—X alloy can be used to form electrical connectors. In some embodiments, the Cu—X ions can be electrodeposited onto a mold, preform, or mandrel and then annealed to precipitate out a particulate phase to enhance the strength of the binary Cu—X alloys.

In contrast to ingot metallurgy, in embodiments of the disclosure, the concentration of X can be increased. In ingot metallurgy the weight % of X that is soluble in Cu can be low (e.g., less than 1 wt. %), while the electroforming process of the disclosure can increase the wt. % of X that is soluble in Cu. For example, without intending to be limiting, if X is P, it can have a solubility of 1.7 wt. % in Cu through ingot metallurgy. However, in accordance with embodiments of the disclosed electroforming process, the solubility of P in Cu can be increased (e.g., 5 wt. %). In another example, if X is Mo, it has a solubility of 0 wt. % in Cu through ingot metallurgy (i.e. insoluble). However, in accordance with embodiments of the disclosed electroforming process, the solubility of Mo can be increased and range from 0.1 to 1.0 wt. %.

Also, the alloying element X can be uniformly dissolved throughout the Cu-phase through the electroforming processes of the disclosure. As such, if the alloy is subjected to a heat treatment for precipitating hardening, the precipitate phase can be more uniformly distributed. In accordance with some embodiments of the disclosure, the heat treatment process can precipitate out intra-grain particulates of the alloying element X and/or intra-grain particulates of $Cu_yX_z$ to increase the hardness and/or yield strength of the binary Cu alloy. In some embodiments, the intra-grain particulates can consume all or nearly all of the alloying element X. Therefore, the alloying element X should be selected to have a low solubility to facilitate precipitation during the heat treatment. In some embodiments, the X ions may have at least 0.1 wt. % solubility in the Cu. In some embodiments, the X ions may have at least 1 wt. % solubility in the Cu. In some embodiments, the X ions may have between 0.1 wt. % and 1 wt. % solubility in the Cu. In yet other embodiments, the X ion may have at least 5 wt. % solubility in the Cu. In still other embodiments, the X ion may have up to 30 wt. % solubility in the Cu.

By way of illustrative example, without intending to be limiting, in accordance with embodiments of the disclosed electroforming process, X can be Mo. In ingot metallurgy, Mo has a solubility of 0 wt. % in Cu. However, the electroplating process, in accordance with embodiments of the disclosure, can increase the super-saturated dissolved content of Mo in Cu to range from 0.1 to 1.0 wt. %. The electroplating process allows for increased amounts of Mo in super-saturated solid in Cu and enables the formation of solid solution Mo within the Cu phase. The addition of Mo in solid solution within the Cu phase improves the strength of the alloy; however, because the solubility of the Mo is relatively low, the high conductivity of the Cu is retained. In some embodiments, the yield strength and/or hardness of the Cu—X alloy (e.g. X is Mo) can be further increased through an aging treatment and/or precipitation hardening process, which are discussed in more detail below.

For example, the presence of Mo in some embodiments, introduced via electroplating processes in accordance with the disclosure, allows for control of grain size. In conventional ingot metallurgy using alloy melts, a solid solution of Mo in Cu is not achievable because Mo has an equilibrium solubility of zero in Cu; therefore the Mo forms a coarse phase when the alloy melt is solidified. However, when Mo is electroplated with Cu in accordance with embodiments of the disclosure, a solid solution of Mo in the Cu can be achieved. In such embodiments, the Mo can be a nano-size grain former. In other embodiments, X may be W, which can also be a nano-size grain former. Like Mo, the presence of W in some embodiments, introduced via electroplating processes, in accordance with the disclosure, allows for control of grain size.

In some embodiments, the yield strength of the binary Cu—X alloys can also be enhanced through grain refinement (i.e., controlling the size of the Cu phase grains). The addition of the X phase via the electroplating process, in accordance with embodiments of the disclosure, can allow for stabilization of nano-scale grain size resulting in high strength alloys in combination with high electrical conductivity. In conventional metallurgy (i.e., casting, rolling, etc.), the Cu-phase can have coarse grains, while in embodiments of the disclosure, electroforming process can produce fine (i.e., nano-scale) grains for the Cu-phase. The principal grain refining effect is due to the solute addition. By way of illustrative example, without intending to be limiting, in embodiments with X being Mo, the Mo solute has been shown to stabilize the average grain size (i.e. average diameter of grain) to be about an 25 nm in 0.5 wt. % Mo samples, in the binary alloy as formed.

The Cu—X alloys as formed can further be strengthened through an aging treatment and/or precipitation hardening process. For example, in the alloys as formed through deposition of the Cu and X ions via the electroplating process, the average grain size can be 25 nm (i.e. average diameter of the grains) and via an aging treatment and/or precipitation hardening process, the average grain size of the alloy can be increased while some of the X can be precipitated out to act as strengthening intra-grain particulates. For example, the grain diameters can grow from 25 nm up to 800 nm while the intra-grain particulates containing X can be less than 10 nm in size (i.e. diameter). This can increase the yield strength and or hardness of the binary Cu alloy in comparison to the alloy as formed via the electroplating process.

Grain refinement can be used to strengthen the copper binary alloy by reducing the grain size of the Cu phase to introduce more grain boundaries to create obstacle dislocation motion, described by the Hall-Petch (H-P) equation:

$$\sigma_y=\sigma_0+d^{-1/2}$$

However, the strength does not monotonously increase with decreasing grain size.

In some embodiments of the disclosure, refinement of the Cu-phase grain size can be facilitated by the inclusion of grain refining additives to the electrolyte bath. In other embodiments, additives that support Cu grain growth (sometimes called accelerators) can be used. For example, without intending to be limiting, one additive for supporting Cu grain growth is di(sodium 3-sulfonate-1-propyl) sulfide [$NaSO_3$—$(CH_2)_3$—S—S—$(CH_2)_3$—$SO_3Na$]. This additive can accelerate the plating rate by helping Cu deposit onto a suitable crystalline site on the surface of a cathode preform, mandrel, or mold. In still other embodiments, the leveling agents can be used to improve the Cu thickness distribution. One non-limiting example of a leveling agent is polyethylene glycol. This leveling agent can be found in the high current density regions of the cathode preform, mandrel, or mold surface. Thus, it can reduce the thickness difference at the high current density area and the low current density area. In other embodiments, the leveling agent can be a reaction product of a heterocyclic amine with an epihalohydrin, a reaction product of a compound including a heteroatom chosen from nitrogen, sulfur and a mixture of nitrogen and sulfur, with a polyepoxide compound containing an ether linkage, a 1:0.6 reaction product of imidazole with BDE, or any other suitable leveling agent known in the art.

In embodiments of the disclosure, the Cu and alloying element X ions can be deposited at the same time (i.e., co-deposited). In some embodiments, the Cu and X ions can be deposited at the same or similar rates.

Because the more noble element between Cu and X will want to plate out from the electrolyte solution at a faster rate, the Cu and X can be co-deposited by selecting the X to have an electrode potential that is compatible with Cu, or by the addition of chemical complexes in the electrolyte solution (i.e. plating bath).

For example, in some embodiments, X can have a similar electrode potential as Cu. In other words, the difference in electrode potential between Cu and X, known as ΔV, is relatively small. In some embodiments, the ΔV can be ±0.20 V such that Cu and X deposit (or plate) out of the electrolyte solution at a similar rate. In other embodiments, the ΔV can be less than ±0.25 V. In yet other embodiments, the ΔV can be less than ±0.3 V. In still other embodiments, the ΔV can be less than ±0.5 V. In such embodiments, the difference in electrode potential can be easily controlled by the concentration of the Cu and X ions.

When the Cu and X ions in an electrolyte bath have similar electrode potentials, the weight ratio of the Cu and X deposited as an alloy tends to be similar to the ratio of concentrations of the Cu and X ions in the electrolyte bath. This characteristic lends itself to predictability and control of the deposited alloy composition within the deposited feature.

In contrast, when the alloying element X does not have a similar electrode potential, prediction and control of the alloy composition within the deposited feature becomes more challenging. In such embodiments, the ΔV may be large (e.g., ±0.50 V). In some embodiments, the ΔV can be greater than ±0.3 V. In other embodiments, the ΔV can be greater than ±0.5 V. In still other embodiments, the ΔV can be as larger as ±1.35 V. In such embodiments, if the ΔV is large, chemical complexes can be added to the electrolyte bath. The addition of the chemical complexes can result in an effective ΔV that is smaller, such that the Cu and X can be co-deposited at a similar plating rate. Some examples of chemical complexes that can be used are EDTA, HEDTA, DTPA, GLDA, NTA, EDG, PDTA, oxalic acid, citric acid, propionic acid, malic acid, nitrilotriacetic acid, tartaric acid, as well as other suitable chemical complexes known to one of ordinary skill in the art.

Further to the addition of chemical complexes (such as chelating agents), in some embodiments, the current used for plating can be used to reduce the electrode potential difference by using a pulse current. The pulse current can be used in some embodiments with chemical complexes, while in other embodiments the pulse current can be used without the addition of chemical complexes.

The difference in electrochemical potential of the Cu and X ions can describe the thermodynamic portion of the plating process. The kinetic portion of the plating process involves the speed of the ions near the surface to be deposited onto the surface, which depletes the concentrations ion at the surface. Meanwhile, the ions in the bulk of the solution move to the near surface region, which replenishes the ion concentrations at the near surface region. For example, without intending to be limiting, for a binary Cu—Cr alloy, Cu and Cr ions are in the electrolyte bath. The Cu has a lower voltage for the deposition than the Cr ions and thus Cu has a preference for deposition over the Cr ions. As such, when the applied current is high enough, Cu ions near the surface region can be consumed at faster rate than the Cu ions can be replenished from the bulk of the electrolyte solution. Therefore, at a certain point, the Cr ions can start to co-deposit with the Cu ions.

However, if a high current is applied continuously there may not be not enough ions near the surface to continue deposition of Cu ions. In such instances, the plating layer can become dendritic. To enhance the ability of the Cu and Cr ions to be co-deposited and limit the plating layer from the possibility of becoming dendritic, a pulse (or complex waveform) plating approach can be used. In embodiments using a pulse (or complex waveform) to apply the current, the current can be applied for a period of time (i.e. a pulse) and then stopped for a period of time. In operation, when the current is applied for the pulse period, both Cu and X (e.g., Cr) ions near the surface region of the cathode preform, mandrel, or mold are co-deposited onto the surface. After the pulse period ends, the current stops, which allows ions in the bulk of the electrolyte to move towards the surface region. This allows metals with higher difference in electrochemical potential to be plated together.

In some embodiments, a complex waveform may be used to provide the pulses of current. An example, without intending to be limiting, of a waveform that can be used is the following:

(1) 20 ASD (amperes per square decimeter) for 20 msec (that allows Cu and Cr to co-deposit)

(2) −50 ASD for 3 ms (this helps distribution and remove weakly formed species)

(3) no current for 5 msec (allows ions to move to the surface region)

(4) 2 ASD for 20 msec (that allows Cu to deposit)

(5) −50 ASD for 3 ms (this helps distribution and remove weakly formed species)

(6) no current for 5 msec (allows ions to move to the surface region).

This sequence can be repeated successively, until a desired amount of the Cu and X ions are deposited and/or until the plating layer is a desired thickness. In other embodiments, the time and current density of the two pulses can be adjusted, which allows for control of the X/Cu ratio in the deposit.

In other embodiments, the Cu can have a higher voltage for deposition than X such that ΔV is positive. For example, without intending to be limiting, for a binary Cu—X alloy, X can be Mo. The Cu has a higher voltage for the deposition than the Mo ions. Thus, ΔV is positive and the Mo has a lower voltage for the deposition than the Cu ions and thus Mo has a preference for deposition over the Cu. As such, when the applied current is high enough, the Cu ions can co-deposit with the Mo ions.

In addition to the electrode potential of the Cu and X ions, other factors can affect the plating (depositing) rate of the Cu and X ions. Other factors can include the cathode efficiency, the current density, the addition of chemical complexes and/or grain refining additives in the electrolyte bath, agitation of the electrolyte bath, the pH of the electrolyte bath, the temperature of the electrolyte bath, as well as the concentration of Cu and X ions, and concentration of chemical complexes and/or grain refining additives. The cathode current is a function of the applied current, the current required to plate the Cu and X ions, the current conducted in the electrolyte bath, the current due to generation of hydrogen, and the current due to other electrochemical reactions.

In some embodiments, the co-depositing of Cu and an alloying element X may proceed until at least a 50 um thick layer of the binary Cu—X alloy is deposited on the cathode preform. In other embodiments, the co-depositing of Cu and an alloying element X may proceed until at least a 100 um thick layer of the binary Cu—X alloy is deposited on the cathode preform. In yet other embodiments, the co-depositing of Cu and an alloying element X may proceed until at least a 200 um thick layer of the binary Cu—X alloy is deposited on the cathode preform. When the required thickness of alloy has been deposited, the alloy-covered preform, mold or mandrel can be removed from the electrolyte bath and the electrodeposited metal can be separated from the preform, mold, or mandrel to create an electroform, which is a separate, free-standing article composed entirely of the electrodeposited metal.

In some embodiments, after the binary Cu—X alloy is plated onto the cathode preform, mold, or mandrel, the binary Cu—X alloy can optionally undergo a heat treatment process to further increase the hardness of the electroformed binary Cu—X alloy. By way of illustration, without intending to be limiting, an exemplary binary Cu—Mo alloy can have a hardness of 260 HV as electrodeposited and then be heat treated to improve the hardness to over 300 HV. In embodiments, the hardness of the binary Cu—X alloy can be increased by at least 20% via the heat treatment process. In some embodiments, the hardness of the binary Cu—X alloy can be increased by at least 25% via the heat treatment process. In other embodiments, the hardness of the binary Cu—X alloy can be increased by at least 30% via the heat treatment process. In yet other embodiments, the hardness of the binary Cu—X alloy can be increased by at 20% to 50% via the heat treatment process.

The heat treatment process involves heating the binary Cu—X alloy to a temperature of at least 100° C. for a time. In some embodiments, the binary Cu—X alloy can be heated to a temperature of at least 200° C., while in other embodiments, the binary Cu—X alloy can be heated to a temperature of at least 350° C. In still other embodiments, the binary Cu—X alloy can be heated to a temperature of at least 400° C. In yet other embodiments, the binary Cu—X alloy can be heated to a temperature between 100° C. and 600° C. In some embodiments, the binary Cu—X alloy may be heated for at least 30 minutes, while in other embodiments the alloy may be heated for at least 100 minutes. In yet other embodiments, the binary Cu—X alloy may be heated for a time ranging from 30 minutes to 300 minutes.

In other embodiments, the binary Cu—X alloy can undergo a heat treatment process to precipitate strengthen the alloy. During the heat treatment process, the Cu—X alloy can be heated to a temperature sufficient to precipitate out X and/or $Cu_yX_z$ as intra-grain particulates within the Cu-phase grains to strengthen the alloy. In some embodiments, the Cu—X alloy can be heated for a time sufficient to precipitate some of the X phase into intra-grain particulates. In some embodiments the intra-grain particulates can be X particles, while in other embodiments the intra-grain particulates can be $Cu_yX_z$ particles. In yet other embodiments the intra-grain particulates can be a combination of X particles and $Cu_yX_z$ particles.

In some embodiments, the volume fraction of the intra-grain particulates can be at least 0.1% vol. In other embodiments, the volume fraction of the intra-grain particulates can be at least 0.25% vol. In yet other embodiments, the volume fraction of the intra-grain particulates can be at least 1% vol.; while in other embodiments it can be 5% vol. In still other embodiments, the volume fraction of the intra-grain particulates can be up to 15% vol.

In embodiments of the disclosure, articles and/or devices are made which have been electroformed from a binary Cu—X alloy, where Cu and X are co-deposited on a mold, preform, or mandrel. X is chosen from the group consisting of Cr, Fe, W, Mo, B, Co, Ag, and P. In some embodiments, X can be chosen from a group consisting of Cr, Fe, W and Mo. In other embodiments, the articles and/or devices are formed by electroplating suitably-dimensioned, load-bearing substrates and/or substrate mandrels with the binary Cu—X alloys of the disclosure.

Figure 2A:
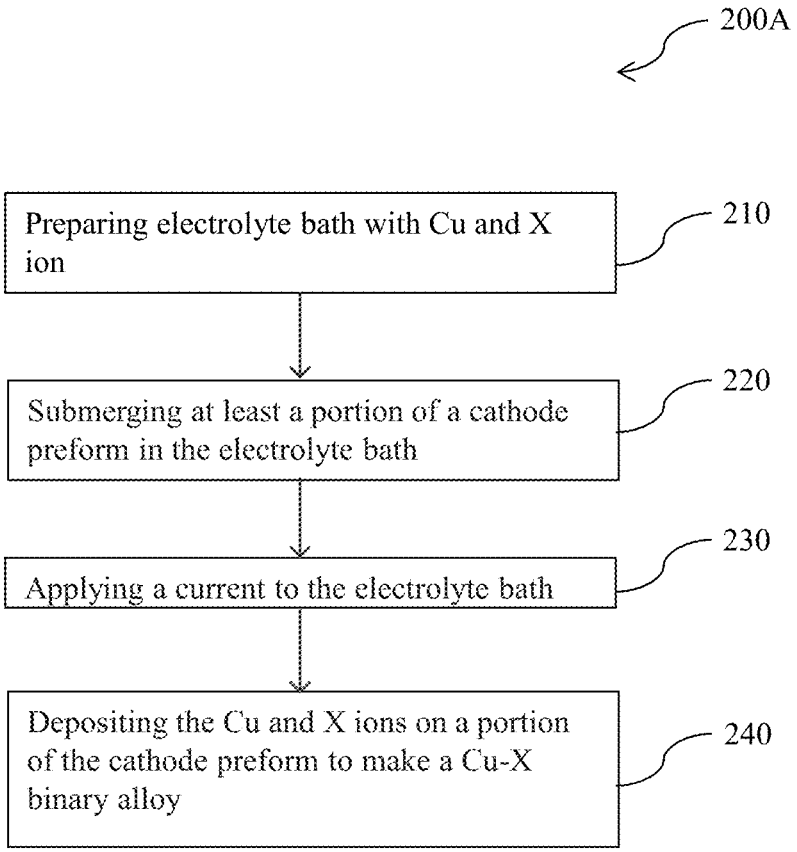
FIG. 2A depicts the steps of a method of electroforming a binary Cu—X alloy in accordance with embodiments of the disclosure.

As shown in FIG. 2A, the electroforming process 200 A of some embodiments of the disclosure includes step 210 of preparing an electrolyte bath with Cu and X ions, step 220 of submerging at least a portion of a cathode preform in the electrolyte bath, step 230 of applying a current to the electrolyte bath, and step 240 of depositing the Cu and X ions on a portion the cathode preform to form a binary Cu—X alloy. In some embodiments, the electroforming process can also include separating the electroformed Cu—X article from the cathode preform.

In some embodiments the electrolyte bath can be an aqueous solution, while in other embodiments the electrolyte bath can be non-aqueous. In some embodiments, the electrolyte bath can be a copper acid bath, containing copper ions, X ions, and either sulfate or fluoborate ions along with the corresponding acids. Suitable sources of copper ions include, but are not limited to, copper sulfate, copper chloride, copper acetate, copper nitrate, copper fluoroborate, copper methane sulfonate, copper phenyl sulfonate, copper phenol sulfonate and copper p-toluene sulfonate. In some embodiments, the copper acid bath can include optional additives. By way of example, without intending to be limiting, the acid bath can include Cu sulfate, $H_2SO_4$, di(sodium 3-sulfonate-1-propyl) sulfide, and polyethylene glycol. In other embodiments, the electrolyte bath can include a copper pyrophosphate solution as a source for the Cu ions. In still other embodiments, the electrolyte bath can include an ionic liquid.

As discussed previously, the plating (i.e., deposition) rate of the Cu and X ions is not only effected by electrode potential of the ions, but other factors that include the cathode efficiency, the current density, the addition of chemical complexes and/or grain refining additives in the electrolyte bath, agitation of the electrolyte bath, the pH of the electrolyte bath, the temperature of the electrolyte bath, as well as the concentration of Cu and X ions, and concentration of chemical complexes and/or grain refining additives.

In some embodiments, chelating agents (e.g., chemical complexes) can be used to stabilize the metals while allow a high current pulse to deposit the metals. Possible chelating agents are EDTA, HEDTA, DTPA, GLDA, NTA, EDG, PDTA, oxalic acid, citric acid, propionic acid, malic acid, nitrilotriacetic acid, tartaric acid.

In other aspect, the chelating agents can facilitate catalysis reactions of the X compound to create X ions in the electrolyte bath. Without wishing to be limited to a particular mechanism or mode of action, the source for the chelating agents can be added in solution to the electrolyte bath or the cathode preform may provide a source for the chelating agent.

In some embodiments, the chelating agents can be, but are not limited to, zinc (Zn), cadmium (Cd), or other suitable agent. In some embodiments, the chelating agents, such as zinc, can be in any form known in the art. For example, in some embodiments, the chelating agent, such as zinc, can be provided in the electrolyte bath as a metal salt. In such embodiments, the zinc salt can be zinc nitrate $Zn(NO_3)_2$, zinc chlorate $Zn(ClO_3)_2$, zinc sulfate ($ZnSO_4$), zinc phosphate ($Zn_3(PO_4)_2$, zinc molybdate ($ZnMoO_4$)), zinc chromate $ZnCrO_4$, zinc arsenite $Zn(AsO_2)_2$, zinc arsenate octahydrate ($Zn(AsO_4)_2.8H_2O$), or any other known suitable source of zinc.

In other embodiments, the cathode preform may be a source for providing the chelating agents. By way of illustration for example, but not limited to, the cathode preform can be brass comprising zinc and be a source for a zinc chelating agent.

Figure 2B:
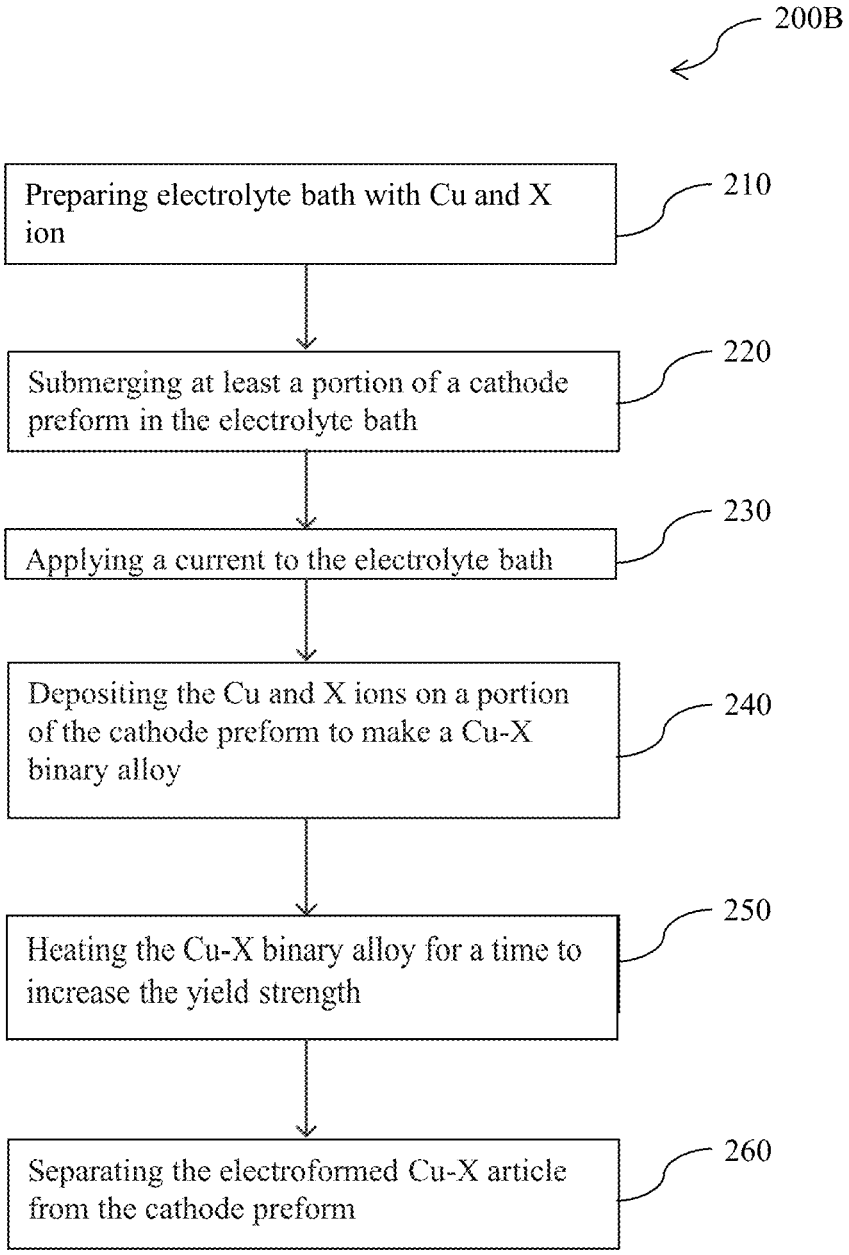
FIG. 2B depicts the steps of another embodiment of a method of electroforming a binary Cu—X alloy in accordance with embodiments of the disclosure.

Another embodiment of the method of electroforming a binary Cu—X alloy is shown in FIG. 2B. The electroforming process 200B of some embodiments of the disclosure includes step 210 of preparing an electrolyte bath with Cu and X ions, step 220 of submerging at least a portion of a cathode preform in the electrolyte bath, step 230 of applying a current to the electrolyte bath, step 240 of depositing the Cu and X ions on a portion the cathode preform to form a binary Cu—X alloy, and an additional optional step 250 of heat treating the binary Cu—X alloy to age harden the alloy. In some embodiments, the electroforming process can also include step 260 of separating the electroformed Cu—X article from the cathode preform.

In such embodiments, steps 210-240 of method 200B are similar to the corresponding steps of method 200A. However, method 200B can include step 250 in which after the binary Cu—X alloy is plated onto the cathode preform, mold, or mandrel, the binary Cu—X alloy can undergo a heat treatment process to further increase the hardness of the electroformed binary Cu—X alloy. The heating step 250 process involves heating the Cu—X binary alloy to a temperature for a time to increase the hardness of the binary Cu—X alloy. In some embodiments, the binary Cu—X alloy can be heated to a temperature of at least 100° C. for a time. In some embodiments, the binary Cu—X alloy can be heated to a temperature of at least 200° C., while in other embodiments, the binary Cu—X alloy can be heated to a temperature of at least 350° C. In still other embodiments, the binary Cu—X alloy can be heated to a temperature of at least 400° C. In yet other embodiments, the binary Cu—X alloy can be heated to a temperature between 100° C. and 600° C. In some embodiments, the binary Cu—X alloy may be heated for at least 30 minutes, while in other embodiments the alloy may be heated for at least 100 minutes. In yet other embodiments, the binary Cu—X alloy may be heated for a time ranging from 30 minutes to 300 minutes.

In some embodiments, the heating step 250 can include precipitate strengthening the alloy. In such embodiments, during the heat treatment process, the Cu—X alloy can be heated to a temperature sufficient to precipitate out X and/or $Cu_yX_z$ intra-grain particulates within the Cu-phase grains. In some embodiments, the Cu—X alloy can be heated for a time sufficient to precipitate out all or nearly all of the X phase into intra-grain particulates. In some embodiments the intra-grain particulates can be X particles, while in other embodiments the intra-grain particulates can be $Cu_yX_z$ particles, while in still other embodiments the intra-grain particulates can be a combination of X and $Cu_yX_z$ particles.

In such embodiments, the hardness of the binary Cu—X alloy can be increased by at least 20% via the precipitate hardening. In some embodiments, the hardness of the binary Cu—X alloy can be increased by at least 25% via the precipitate hardening. In other embodiments, the hardness of the binary Cu—X alloy can be increased by at least 30% via precipitate hardening. In other embodiments, the hardness of the binary Cu—X alloy can be increased by at least 40% via precipitate hardening. In other embodiments, the hardness of the binary Cu—X alloy can be increased by at least 50% via precipitate hardening. In yet other embodiments, the hardness of the binary Cu—X alloy can be increased by at 20% to 50% via the precipitate hardening.

By way of illustrative example, without intending to be limiting, for exemplary Cu—Mo alloys with 0.1 wt. %-0.5 wt. % Mo, some of the Mo can be precipitated out as intra-grain particulate. In some embodiments, the intra-grain particulates can be Mo particles, while in other embodiments, the intra-grain particulates can be $Cu_yMo_z$ particles, while in still other embodiments, the intra-grain particulates can be a combination of Mo particles and $Cu_yMo_z$ particles.

In some embodiments, the volume fraction of the intra-grain particulates can be at least 0.1% vol. In other embodiments, the volume fraction of the intra-grain particulates can be at least 0.25% vol. In yet other embodiments, the volume fraction of the intra-grain particulates can be at least 1% vol.; while in other embodiments it can be 5% vol. In still other embodiments, the volume fraction of the intra-grain particulates can range from 0.2 to 1.5% vol.

Figure 3:
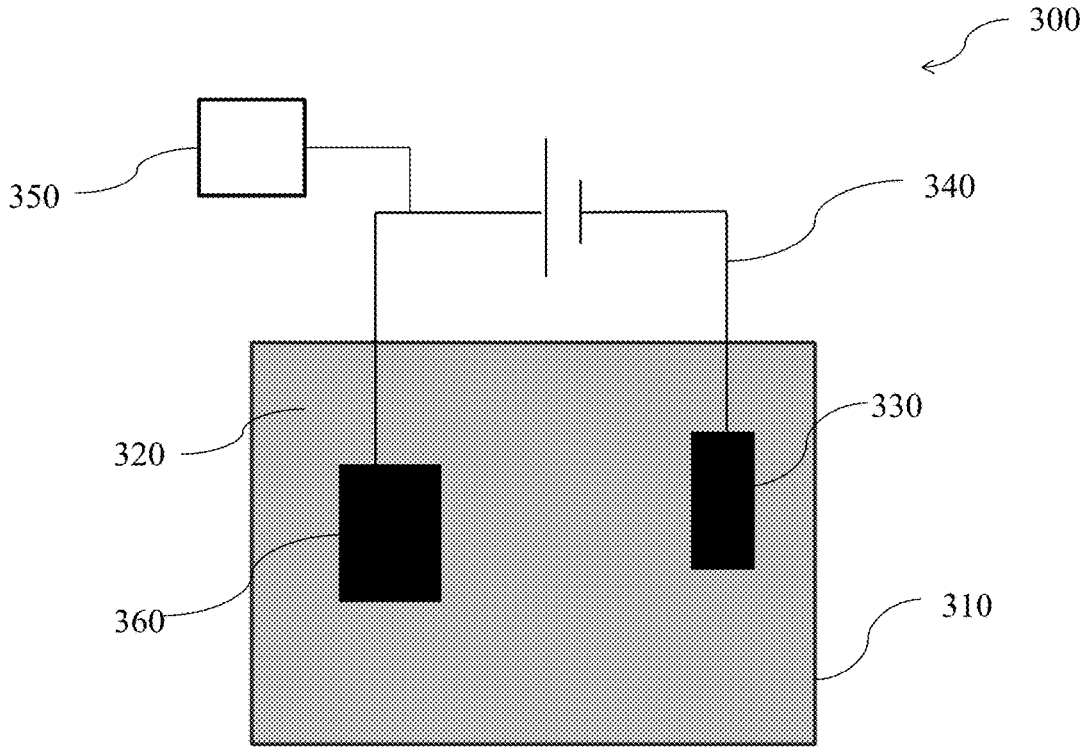
FIG. 3 depicts a schematic of a chamber for electroforming a binary Cu—X alloy in accordance with embodiments of the disclosure.

In some embodiments, as illustrated in FIG. 3, the electroforming process can be a conducted in a chamber 300 for electrodepositing the Cu and X ions that includes a reactor 310, an electrolyte bath with Cu and X ions 320, an electrode 330, e.g., an anode, a power supply 340, and a controller 350. Further, a cathode preform 360 (also referred to as a mold or mandrel) is at least partially submerged in the electrolyte bath 320. The electrolyte bath 320 includes a source of the Cu and X metal ion(s) to be deposited on the surface of the cathode preform. In some embodiments, the electrolyte bath can include chemical complexes so the Cu and X plate at a similar rate. In some embodiments, the electrolyte bath can include additives to facilitate grain refinement of the Cu phase.

In operation, the electrode 330 (e.g., anode) is in electrical contact with the electrolyte bath. The power supply 340 provides an electrical current (e.g., power) between the cathode preform 360 and the electrode 330 which promotes the electrodepositing of the Cu and X ions onto the cathode preform.

In some embodiments, the anode can be soluble, while in other embodiments, the anode can be insoluble. In embodiments having a consumable anode, the anode is made of the ions (Cu or X) being deposited and it dissolves to replenish the Cu and/or X ions in solution. If an insoluble anode is used, in some embodiments, periodic additions of metal salts can be made to the solution to maintain the Cu and/or X ion content.

The current used for electrodepositing the ions does not always have to be applied as a continuous flow. For example, pulse plating or reverse pulse plating can be used. In pulse or reverse pulse plating, the current is applied in short bursts of high intensity followed by a period in which no current is applied. The cycles represent the ratio of on time to off time, (i.e., the duty cycle), and the frequency. By varying the duty cycle and the frequency, desirable alterations of the characteristics of the deposits can be obtained. Thus, the electrodeposition process can, for instance, be controlled by modulating either the potential or the plating current density. In other embodiments, the pulse can be a complex waveform that includes two or more currents. For example, a complex waveform may include a first current pulse at a first voltage to co-deposit the Cu and X ions, and a second current pulse at a second voltage to deposit Cu ions. Furthermore, properties of the deposited Cu and X ions are determined by factors such as electrolyte composition, pH, temperature, agitation, potential and current density.

Non-Limiting Example Alloys

Cu—Cr Alloys

In some embodiments, the binary Cu—X alloy can be a Cu—Cr alloy. In such embodiments, an acid copper bath, copper pyrophosphate bath or ionic liquid, in accordance with embodiments described above, can be used that includes Cr (II) or Cr (III) sulfate. Suitable sources of copper ions include, but are not limited to, copper sulfate, copper chloride, copper acetate, copper nitrate, copper fluoroborate, copper methane sulfonate, copper phenyl sulfonate, copper phenol sulfonate and copper p-toluene sulfonate. To plate the Cu and Cr ions, a complex waveform can be used to apply current to the electrolyte bath. In some embodiments, the complex waveform can include a first pulse with current control that applies a voltage that allows the Cr ions to co-deposit with Cu, and a second pulse with current control that allows the Cu ions to deposit. In some embodiments, additional chelating agents can be added to the electrolyte bath to affect the ratio of Cr—Cu deposited. In some embodiments, the chelating agents can include, but are not limited to, zinc (Zn), cadmium (Cd), or other suitable agent for facilitating catalysis reactions of the Cr compound to create Cr ions in the electrolyte bath.

Cu—W Alloys

In some embodiments, the binary Cu—X alloy can be a Cu—W alloy. In such embodiments, an acid copper bath, copper pyrophosphate bath, or an ionic liquid can be used for the source of copper ions, in accordance with embodiments described above, that includes W ions stabilized by citric acid. Suitable sources of copper ions include, but are not limited to, copper sulfate, copper chloride, copper acetate, copper nitrate, copper fluoroborate, copper methane sulfonate, copper phenyl sulfonate, copper phenol sulfonate, copper p-toluene sulfonate, and copper pyrophosphate. In some embodiments, the W ions with citric acid can be derived from ammonium tungstate or sodium tungstate dehydrate with citric acid. In other embodiments, the citric acid may be replaced with Sulfobenzoic acid imide. To plate the Cu and W ions, a complex waveform can be used to apply current to the electrolyte bath. In some embodiments, the complex waveform can include a first pulse with current control that applies a voltage that allows the W ions to co-deposit with Cu, and a second pulse with current control that allows the Cu ions to deposit. The Cu and W ions can be codeposited on a metal cathode preform. In some embodiments, additional chelating agents can be added to the electrolyte bath to affect the ratio of Cu—W deposited. In some embodiments, the chelating agents can include, but are not limited to, zinc (Zn), cadmium (Cd), or other suitable agent for facilitating catalysis reactions of the W compound to create W ions in the electrolyte bath.

Cu—Fe Alloys

In some embodiments, the binary Cu—X alloy can be a Cu—Fe alloy. In such embodiments, an acid copper bath, copper pyrophosphate bath, or ionic liquid can be used for the source of copper ions, in accordance with embodiments described above, can be used that includes Fe ions (e.g., $Fe_3^+$). Suitable sources of copper ions include, but are not limited to, copper sulfate, copper chloride, copper acetate, copper nitrate, copper fluoroborate, copper methane sulfonate, copper phenyl sulfonate, copper phenol sulfonate and copper p-toluene sulfonate. To plate the Cu and Fe ions, a complex waveform can be used to apply current to the electrolyte bath. In some embodiments, the complex waveform can include a first pulse with current control that applies a voltage that allows the Fe ions to co-deposit with Cu, and a second pulse with current control that allows the Cu ions to deposit. The Cu and Fe ions can be codeposited on a cathode preform. The cathode preform can be a metal including brass, stainless or any other suitable metal. In some embodiments, additional chelating agents can be added to the electrolyte bath to affect the ratio of Cu—F deposited. In some embodiments, the chelating agents can include, but are not limited to, zinc (Zn), cadmium (Cd), or other suitable agent for facilitating catalysis reactions of the Fe compound to create Fe ions in the electrolyte bath.

Cu—Mo Alloys

In some embodiments, the binary Cu—X alloy can be a Cu—Mo alloy. In such embodiments, an acid copper bath, in accordance with embodiments described above, can be used that includes Mo ions stabilized by citric acid. Suitable sources of copper ions include, but are not limited to, copper sulfate, copper chloride, copper acetate, copper nitrate, copper fluoroborate, copper methane sulfonate, copper phenyl sulfonate, copper phenol sulfonate and copper p-toluene sulfonate. In some embodiments, the Mo ions may be provided by a molybdate, a molybdenum chloride, a molybdenum fluoride, a molybdenum oxide, or other suitable molybdenum compound. In other embodiments, a copper pyrophosphate bath can be used for the source of copper ions. In still other embodiments, the source of copper ions can be an ionic liquid.

To plate the Cu and Mo ions, a complex waveform can be used to apply current to the electrolyte bath. In some embodiments, the complex waveform can include a first pulse with current control that applies a voltage that allows the Mo ions to co-deposit with Cu, and a second pulse with current control that allows the Cu ions to deposit. The Cu and Mo ions can be codeposited on a cathode preform. The cathode preform can be a metal, of example, but not limited to, brass, stainless or any other suitable metal.

In some embodiments, additional chelating agents can be added to the electrolyte bath to affect the ratio of Cu—Mo deposited. In some embodiments, the chelating agents can include, but are not limited to, zinc (Zn), cadmium (Cd), or other suitable agent for facilitating catalysis reactions of the molybdenum compound to create Mo ions in the electrolyte bath.

In some embodiments, the chelating agents, such as zinc, can be in any form known in the art. For example, in some embodiments, the chelating agent, such as zinc, can be provided in the electrolyte bath as a metal salt. In such embodiments, the zinc salt can be Zinc nitrate $Zn(NO_3)_2$, zinc chlorate $Zn(ClO_3)_2$, zinc sulfate $(ZnSO_4)_2$, zinc phosphate $(Zn_3(PO_4)_2$, zinc molybdate $(ZnMoO_4))$, zinc chromate $ZnCrO_4$, zinc arsenite $Zn(AsO_2)_2$, zinc arsenate octahydrate $(Zn(AsO_4)_2.8H_2O)$, or any other known suitable source of zinc. In other embodiments, the cathode preform may comprise zinc and be a source for zinc chelating agents.

The alloys and embodiments as described herein can be included in various electronic devices, and in particular, electrical connectors disposed therein. The electrical connects can include board to board (B2B) pins, battery pins, etc. Such electronic devices can be any electronic devices known in the art. For example, the device can be a telephone, such as a mobile phone, and a land-line phone, or any communication device, such as a smart phone, including, for example an iPhone®, and an electronic email sending/receiving device. The alloys can be used in electric connectors in a display, such as a digital display, a TV monitor, an electronic-book reader, a portable web-browser (e.g., iPad®), watch (e.g., AppleWatch), or computer monitor. Devices can also be entertainment devices, including a portable DVD player, conventional DVD player, Blue-Ray disk player, video game console, music player, such as a portable music player (e.g., iPod®), etc. Devices include control devices, such as those that control the streaming of images, videos, sounds (e.g., Apple TV®), or a remote control for a separate electronic device. The device can be a part of a computer or its accessories, laptop keyboard, laptop track pad, desktop keyboard, mouse, and speaker.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A binary Cu alloy comprising Cu and X, where X is selected from the group consisting of Cr, Fe, W, Mo, B, Co, Ag, and P, if X is Mo, Mo ranges from 0.1 wt. % to 2.5 wt. %, wherein the binary Cu alloy as-formed has an average grain diameter of less than 100 nm, wherein the binary copper alloy has a yield strength of at least 600 MPa and an electrical conductivity of at least 20% IACS.

2. The alloy according to claim 1, wherein the yield strength is at least 800 MPa.

3. The alloy according to claim 1, wherein the electrical conductivity is at least 30% IACS.

4. The alloy according to claim 1, where the yield strength is between 900 MPa and 1700 MPa.

5. The alloy according to claim 4, wherein intra-grain particulates comprise at least 0.1% vol. fraction of the alloy.

6. The alloy according to claim 4, wherein intra-grain particulates comprise at least 1% vol. fraction of the alloy.

7. The alloy according to claim 1, where the electrical conductivity is between 30 and 70% IACS.

8. The alloy according to claim 1, wherein X comprises a particulate phase in the alloy.

9. The alloy according to claim 1, wherein X comprises at least 0.1 wt. % of the alloy.

10. The alloy according to claim 1, wherein X comprises at least 1 wt. % of the alloy.

11. A method of making the binary Cu alloy of claim 1 comprising:

submerging at least a portion of a cathode preform in an electrolyte bath, the electrolyte bath comprising Cu and X ions;

applying an electric current to the electrolyte bath to deposit the Cu and X ions on the portion the cathode preform to form the binary Cu alloy; and heating the binary Cu alloy to a temperature of at least 100°C. for a time to increase the hardness of the binary Cu alloy.

12. The method of claim 11, wherein X is Mo.

13. The method of claim 11 where heating the binary Cu alloy for a time comprises precipitation of particles of at least one of X of $Cu_yX_z$.

14. The method of claim 11 wherein the comprising: separating the e binary Cu-X alloy from the cathode preform.

15. The method of claim further comprising: separating the binary Cu alloy from the cathode preform.

16. The method of claim 11 wherein the difference in electrode potential, ΔV, between Cu and X is less than ±0.3 V.

17. The method of claim 16 wherein the electrolyte bath further comprises chemical complexes to have an effective ΔV that is less than ±0.5 V.

18. An electrical connector comprising an electroformed binary CU alloy comprising Cu and X, where X is selected from the group consisting of Cr, Fe, W, Mo, B, Co, Ag, P, is X is Mo, Mo ranges from 0.1 wt. % to 0.5 wt. %., wherein the electroformed binary Cu alloy as-formed has an average grain diameter of less than 100 nm, wherein the electroformed binary Cu alloy has a yield strength of at least 600 MPa and an electrical conductivity of at least 20% IACS.

* * * * *